US006372149B1

(12) United States Patent
Ferro

(10) Patent No.: US 6,372,149 B1
(45) Date of Patent: Apr. 16, 2002

(54) METHOD FOR MAKING A COLORED RELIEF STRIP

(75) Inventor: Mario Ferro, Padoa (IT)

(73) Assignee: Veneta Decalcogomme, Padoa (IT)

( * ) Notice: Subject to any disclaimer, the term of this patent is extended or adjusted under 35 U.S.C. 154(b) by 0 days.

(21) Appl. No.: 09/468,847

(22) Filed: Dec. 22, 1999

(30) Foreign Application Priority Data

Dec. 23, 1998 (IT) ..... MI98A2818

(51) Int. Cl.[7] ..... B41M 5/00

(52) U.S. Cl. ..... 216/10; 216/39; 216/56; 427/149; 101/211; 101/348

(58) Field of Search ..... 216/39, 8, 9, 10, 216/56, 52, 58, 83; 101/211, 348; 427/143, 145, 149

(56) References Cited

U.S. PATENT DOCUMENTS 4,824,621 A * 4/1989 Piepmeier, Jr. et al. ..... 264/41
4,893,952 A 1/1990 Svyatsky
5,099,759 A * 3/1992 Sonobe et al. ..... 101/348
5,306,370 A * 4/1994 Herko et al. ..... 156/155
5,520,739 A * 5/1996 Frazzitta ..... 118/667
5,544,582 A * 8/1996 Bocko et al. ..... 101/211
5,611,984 A * 3/1997 Sculler et al. ..... 264/238
5,636,568 A * 6/1997 Dugan ..... 101/211
5,830,529 A * 11/1998 Ross ..... 427/152
6,062,671 A * 5/2000 Kanda et al. ..... 347/30

FOREIGN PATENT DOCUMENTS

| | | |
|---|---|---|
| DE | 36 18 444 | 5/1987 |
| DE | 197 50 259 | 8/1998 |
| EP | 0 070 643 | 1/1983 |
| JP | 63 144074 | 6/1988 |

* cited by examiner

*Primary Examiner*—Randy Gulakowski
*Assistant Examiner*—Jiri F. Smetana
(74) *Attorney, Agent, or Firm*—Lowe Hauptman Gilman & Berner, LLP

(57) ABSTRACT

The invention relates to a method for making a relief strip, comprising the steps of etching the strip, causing the etched strip to pass through a coloring line, a silicone solution metering unit, to meter a silicone solution on the strip etched portion, introducing the strip into a mold having a plurality of mold cavities of different cross-sections and spacings, therefrom a vacuum metered ink amount is ejected and caused to enter the recess of the material, and causing the strip to further pass through an infrared oven, and finally brushing the strip.

8 Claims, 1 Drawing Sheet

METHOD FOR MAKING A COLORED RELIEF STRIP

BACKGROUND OF THE INVENTION

The present invention relates to a method for making a relief colored strip.

In particular, a prior art method for making relief colored strips comprises the following operating steps.

At first, is carried out an etching step by using a 20/30 ton eccentric press, on a polypropylene support having a size of 9.5 millimeters and a thickness of 400 microns, or on a polyamide support having the same size.

The eccentric press is provided with a mold holder, supporting a mold having a plurality of inside modular letter-shaped recesses each having a length of 4.5 millimeters and a pointed tip.

The composition of a letter array will define a text to be reproduced by the machine.

Then, the etching pressure is adjusted, and the etching thickness is controlled preferably to 80/90 microns.

The etched material is conveyed to a coloring line, or system, which is conventionally called "COLORING MACHINE".

The strip is caused to pass under a liquid colored resin delivery device, using as a base a colored chlorosulphonated polyethylene, and brought into a solution in a rate of 20% of dry extract, with an aromatic solvent.

Suitable rubbing blades remove on the flat portion of the strip the exceeding ink and the strip is then caused to pass through an infrared oven and is brought to a dry condition.

A rotary brush assembly at the outlet of the oven will fully clean residual materials of the strip, more specifically of the flat portion of the strip.

Then, as an end result, we will have an inked portion in the letter recesses, and a remaining perfectly clear portion.

The colored mass is constituted by:

| | |
|---|---|
| Chloro-sulphonated polyethylene base | 618 p |
| $CACO_3$ | 163.5 p |
| Titanium thioxide | 94 p |
| Pigment | 63 p |
| Catalyzer | 1.5 p |
| Aromatic solvent | 60 p |
| Total | 1000 p |

To 1 Kg of the above base material there are added 500 g of an aromatic solvent.

| | |
|---|---|
| Chloro-sulphonated polyethylene | 251 p |
| 200 magnesium oxide | 37 p |
| PE 200 | 7.7 p |
| PolAC 616 | 4.9 p |
| Tinuvin | 0.6 p |
| Aromatic solvent | 698.8 p |
| Total | 1000 p |

However, the above disclosed method has the disadvantageous effect that the ink also adheres to undesired portions of the strip being processed.

SUMMARY OF THE INVENTION

The aim of the present invention is to provide a method for making a relief colored strip in which the ink material is prevented from adhering to undesired portions of the strip, by using a releasing type of process.

Within the scope of the above mentioned aim, a main object of the present invention is to provide a specifically designed ink having very high anti-abrading strength, as well as a very high anti-aging strength against the atmospheric agents and ultraviolet radiation.

The above mentioned aim and objects, as well as yet other objects are achieved by the present invention which specifically relates to a method for making a colored relief strip comprising a first etching step in which said strip is etched, characterized in that said method further comprises the steps of causing said etched strip to pass through a coloring line and a releasing solution metering unit, provided for metering said solution on said strip etched portion, introducing said strip into a mold provided with a plurality of different cross-section and spacing cavities, and causing the ink to exit said cavities under vacuum and in a properly metered condition, to allow said ink to enter the material recess, conveying the strip through an infrared oven and brushing the strip.

DETAILED DESCRIPTION OF THE INVENTION

Figure 1:
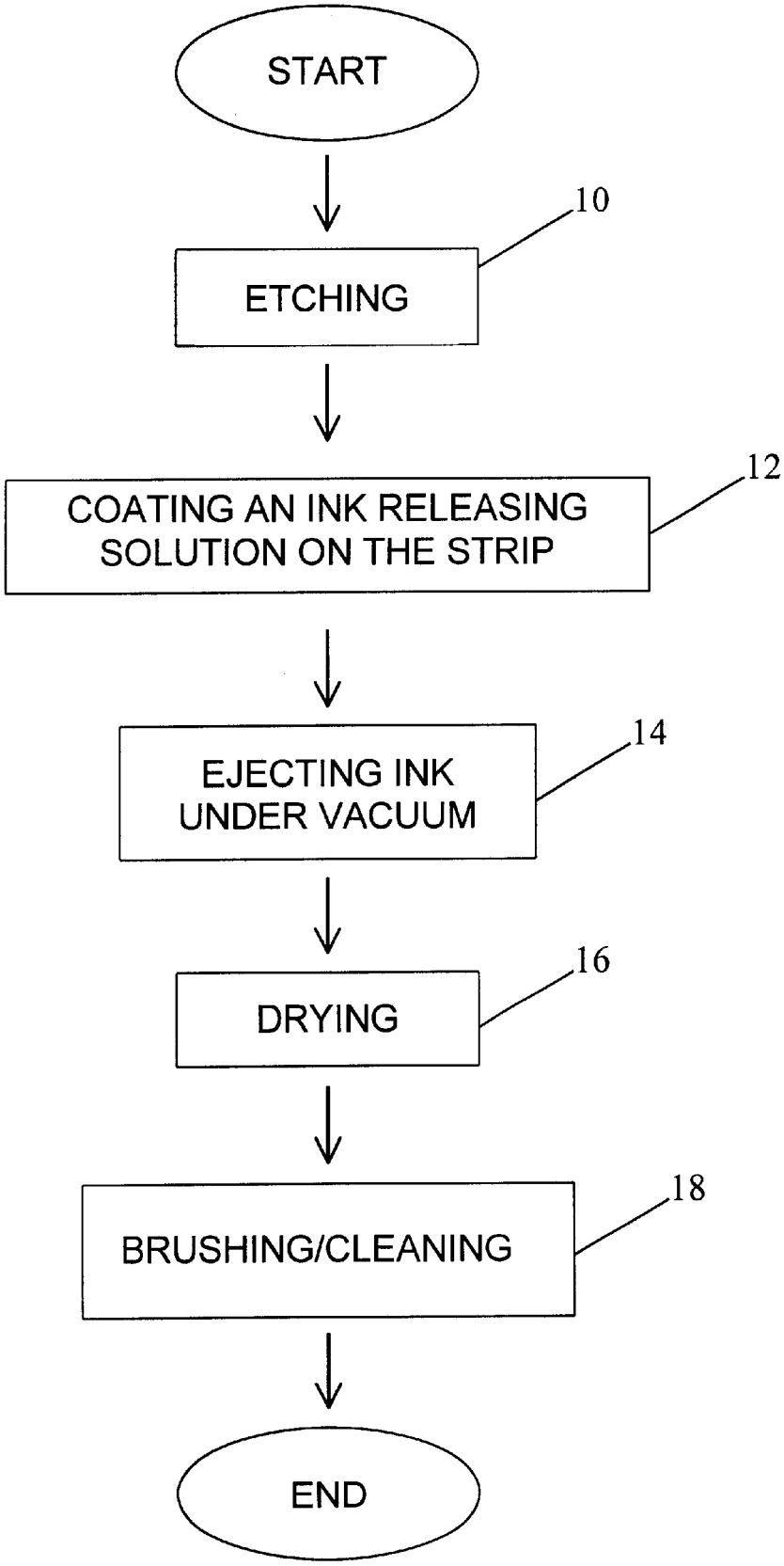
FIG. 1 is a flowchart of the process of the invention.

Further details and advantages as well as important features of the present invention will become more apparent hereinafter from the following detailed exemplary disclosure of a preferred embodiment of the inventive method, which has been given by way of a merely indicative example for illustrating several possible variations of the invention.

More specifically, the inventive method comprises a strip etching step 10, in which the strip is etched by using a 20–30 ton press, on a polypropylene support having a 9.5 millimeter size and a thickness of 400 microns or by using a polyamide support having the same size.

The eccentric press comprises a mold holder, thereon a mold is set, said mold having in its inside a plurality of modular letters having a length of 4.5 millimeters and a pointed tip.

The composition of a letter array will define a text to be reproduced by the machine.

Thus the etching pressure is adjusted, and the etching thickness is controlled, preferably, to 80/90 microns.

After having etched the strip by the above disclosed system, the strip is caused to pass through a coloring line, in which a releasing solution is metered on the etched portion of the strip as shown at 12 in FIG. 1.

This operation is adapted to meter on said strip a primer amount corresponding to a thickness of a micron through the overall flat region of the polypropylene or polyamide material.

This processing step is performed in order to prevent the ink mass from attaching to the flat surface.

Then, the strip is introduced into a mold provided with a plurality of different cross-section and spacing cavities, therefrom the ink is caused to be ejected under vacuum and as suitably metered to enter the material recess as shown at 14 in FIG. 1.

The mold comprises moreover an ink recovering nozzle, for recovering the excess ink and causing it to be sent again to the under-vacuum vessel.

Thus, in such a closed loop operation, the viscosity of the ink will be held unaltered.

Then, the strip is conveyed to an infrared radiation oven and, at the outlet of said oven, the strip is processed through the two sides thereof by a brushing system as shown at 16 and 18 in FIG. 1.

The colored mass comprises:

| | |
|---|---|
| 1 Chloro-sulphonated polyethylene base | 523 p |
| 2 WN3 | 43.8 p |
| 3 Gem resin | 17.7 p |
| 4 Titanium thioxide | 100 p |
| 5 828 Resin | 17.7 p |
| 6 Pigment | 77 p |
| 7 Aromatic solvent | 220.8 p |
| Total | 1000 p |

To 1 kg of the above base material ½ kg aromatic solvent is added.

The color paste comprises

| | |
|---|---|
| 1 Chloro-sulphonated polyethylene | 848 p |
| 2 Ci8 Resin | 50.5 p |
| 3 PolAC 616 | 27 p |
| 4 Titanium | 70.3 p |
| 5 Irganox | 2.1 p |
| 6 Tinovin P | 2.1 p |
| Total | 1000 p |

To 285 gr of said base 715 gr of aromatic solcent are added.

It should be pointed out that a first important advantage of the present invention consists of the releasing process,, which is performed in order to prevent the ink material from adhering to undesired portions of the strips.

A further advantage derives from the construction of the automatic metering head, of the vacuum continuous jet type with a recycle, and of the cleaning system performing the cleaning operation on both sides.

Finally, it should be pointed out that the chemical composition of the ink will provide a greater resistance against abrading, aging, atmospheric agents and UV radiation.

From the above disclosure it should be apparent that the invention fully achieves the intended objectives.

What is claimed is:

1. A method of applying ink in a predetermined pattern on a strip, said method comprising the steps of:

etching said strip to form at least one recess of the predetermined pattern and a flat region surrounding said at least one recess on said strip;

coating said etched strip with an ink releasing solution at least in the flat region of said strip;

ejecting said ink in a vacuum environment on said coated strip, thereby filling said at least one recess with said ink;

drying said inked strip; and removing any residual amount of said ink from the flat region of said strip.

2. The method of claim 1, further comprising recovering an excess amount of said ejected ink and returning said recovered ink to the vacuum environment.

3. The method of claim 1, wherein said ink releasing solution is coated on the flat region of said strip in a primer amount corresponding to a thickness of one micron.

4. The method of claim 1, wherein said removing is carried out by brushing both major sides of said strip.

5. A method of applying ink in a predetermined pattern on a strip, said method comprising the steps of:

etching said strip to form at least one recess of the predetermined pattern and a flat region surrounding said at least one recess on said strip;

coating said etched strip with an ink releasing solution at least in the flat region of said strip;

ejecting said ink in a vacuum environment on said coated strip, thereby filling said at least one recess with said ink;

drying said inked strip; and removing any residual amount of said ink from the flat region of said strip;

wherein said ink comprises colored mass including a chloro-sulphonated polyethylene base of about 523 parts; WN3 of about 43.8 parts; gem resin of about 17.7 parts; titanium tioxide of about 100 parts; 828 resin of about 17.7 parts; pigment of about 77 parts; and aromatic solvent of about 220.8 parts, to a total of about 1000 parts.

6. The method of claim 5, wherein said ink further comprises ½ kg of an aromatic solvent for each kg of said colored mass.

7. The method of claim 5, wherein said ink further comprises a colored paste base including chloro-sulphonated polyethylene of about 848 parts; Ci8 resin of about 50.5 parts; Pol AC 616 of about 27 parts; titanium of about 70.3 parts; irganox of about 2.1 parts; tinovin P of about 2.1 parts, to a total of about 1000 parts.

8. The method of claim 7, wherein said ink further comprises 715 grams of an aromatic solvent for each 285 grams of said colored paste base.

* * * * *